US005279060A

United States Patent [19]

Watson

[11] Patent Number: 5,279,060

[45] Date of Patent: Jan. 18, 1994

[54] PROTECTIVE PADS FOR A FIREARM

[76] Inventor: David Watson, Box 17, Newburg, N. Dak. 58762

[21] Appl. No.: 946,919

[22] Filed: Sep. 18, 1992

[51] Int. Cl.[5] ..... F41C 23/02

[52] U.S. Cl. ..... 42/96; 42/85

[58] Field of Search ..... 42/96, 85, 83, 71.01, 42/72, 73, 74, 75.01

[56] References Cited

U.S. PATENT DOCUMENTS

| | | | |
|---|---|---|---|
| 87,672 | 3/1869 | Herzog et al. | 42/71.01 |
| 1,557,538 | 10/1925 | Jorgenson | 42/74 |
| 1,839,856 | 3/1930 | Anderson | 42/74 |
| 2,116,618 | 5/1938 | Crockett | 42/85 |
| 2,404,904 | 7/1946 | Collins | 42/71.01 |
| 2,542,667 | 12/1947 | Hanson | 206/217 |
| 2,589,912 | 3/1952 | Weld | 42/75.01 |
| 2,701,930 | 2/1955 | Dolan | 42/71.01 |
| 2,763,082 | 9/1956 | Sprague | 42/85 |
| 2,901,018 | 8/1959 | Kolpin | 42/96 |
| 2,932,334 | 4/1960 | Steen | 42/96 |
| 3,226,872 | 1/1966 | Pachmayr | 42/85 |
| 3,665,632 | 5/1972 | Ford | 42/71.01 |
| 3,665,990 | 5/1972 | Hefner, Jr. | 42/74 |
| 4,346,530 | 8/1982 | Stewart et al. | 42/71.01 |

FOREIGN PATENT DOCUMENTS

| | | | |
|---|---|---|---|
| 1471804 | 3/1967 | France | 42/85 |

*Primary Examiner*—Stephen M. Johnson
*Attorney, Agent, or Firm*—Moore & Hansen

[57] ABSTRACT

The present invention provides protective padding for preventing damage to a weapon caused by slings used to carry the weapon and the swivels that are used to attach the sling to the weapon, the invention including at least one pad for having an adhesive inner surface that is attached to the weapon in the area where damage would occur.

6 Claims, 1 Drawing Sheet

PROTECTIVE PADS FOR A FIREARM

The present invention relates generally to firearms and in particular to weapons such as rifles that include a sling to aid in the carrying of the weapon.

BACKGROUND OF THE PRESENT INVENTION

Many long barreled weapons have slings attached to them to facilitate their transportation. The slings are usually adjustably attached at one end to a swivel on the stock of the gun and at the other end to a swivel on the forepiece of the gun. The slings are usually made of leather or a canvas like material and include adjustable brackets for individually sizing the sling as desired. Because the swivels are movable relative to the gun, the swivels will often rub against the stock and forepiece and may seriously damage them thereby. This is undesirable from both an aesthetic viewpoint and a commercial one since the damage may reduce the resale value of the weapon.

It would be desirable to have apparatus for protecting the stock and forepiece from damage caused by the swivel sling.

SUMMARY OF THE PRESENT INVENTION

There is provided by the present invention apparatus for protecting the stock and the forepiece of a rifle or other weapon from damage caused by apparatus associated with a sling. Thus, the present invention provides first and second protective pads for attachment to the stock and forepiece, respectively, of a long barreled weapon in the vicinity of potential damage caused by the swivels and hardware associated with the sling. The stock pad is preferably made of a finely finished leather that has an outwardly facing, aesthetically pleasing surface and an inwardly facing adhesive surface for attachment to the stock. The adhesive surface may likewise form one side of a two-sided adhesive tape with the other side adhered to the inwardly facing surface of the stock pad. The forepiece pad is also preferably made of a finely finished leather that has an outwardly facing, aesthetically pleasing surface and an inwardly facing adhesive surface for attachment to the forepiece. The adhesive surface of the forepiece pad may also form one side of a two-sided adhesive tape with the other side adhered to the inwardly facing surface of the forepiece pad. In one embodiment of the present invention the forepiece pad has an aperture that receives the swivel post by which the sling is attached to the firearm.

DETAILED DESCRIPTION OF THE PRESENT INVENTION

Figures 1, 2, 3, 4:
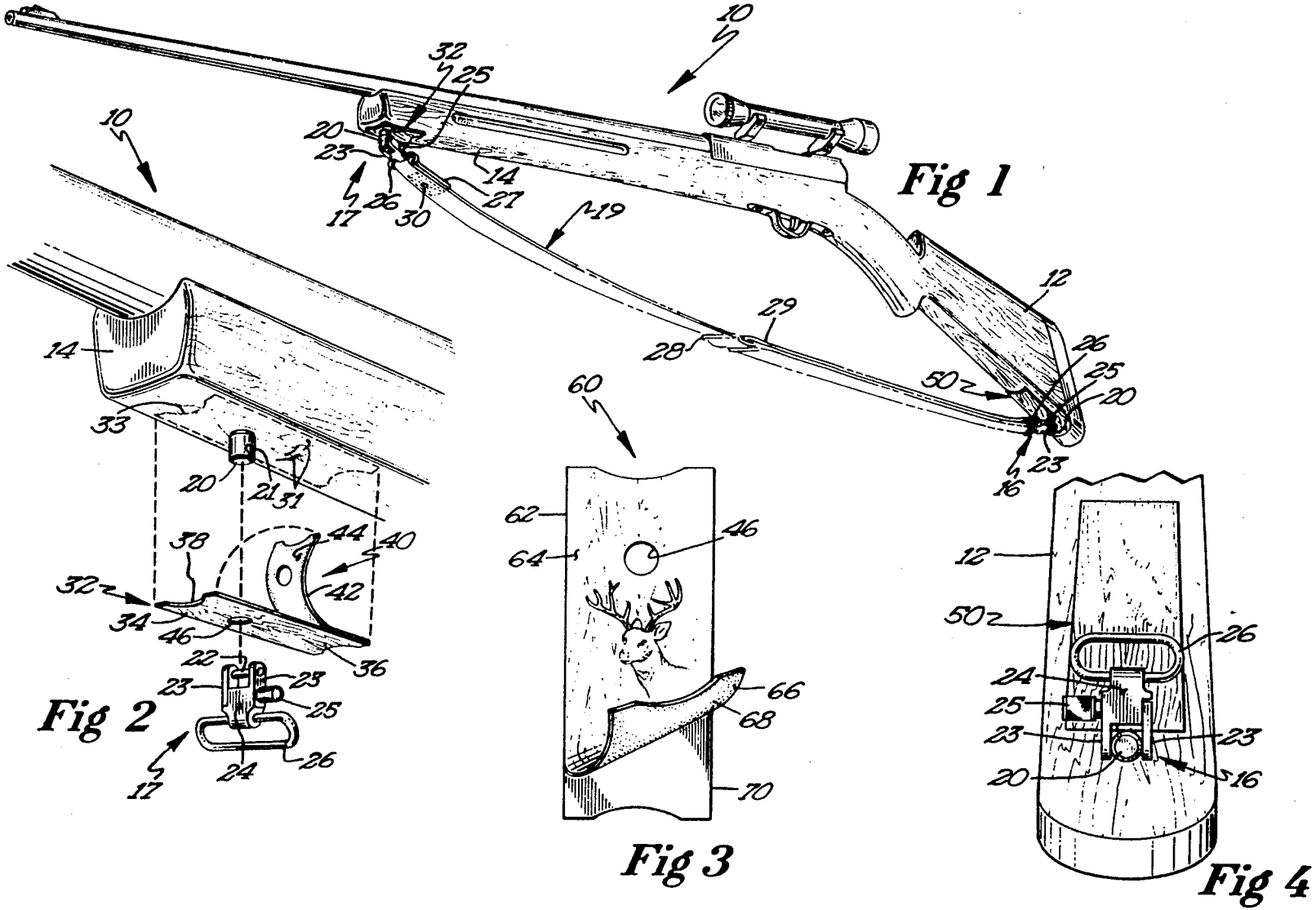
FIG. 1 shows in a perspective view the present invention in use in conjunction with a long barreled firearm.
FIG. 2 illustrates in an exploded perspective view the forepiece pad of the present invention and shows the backing strip for the adhesive surface partially peeled back to expose the adhesive surface.
FIG. 3 shows in a plan view an alternative embodiment of the forepiece pad with the pad partially peeled away from a backing strip to expose the adhesive surface.
FIG. 4 shows in a partial plan view the firearm of FIG. 1 with the stock pad positioned on the firearm stock so as to protect it from damage by the swivel.

FIG. 1 shows a firearm 10 such as the rifle depicted wherein the present invention may find application. Rifle 10 includes a stock 12 and a forepiece 14. Stock 12 and forepiece 14 each have a detachable swivel 16 and 17, respectively, attached thereto. Swivels 16 and 17 support a sling 19 used to carry the rifle 10. Sling 19 is attached to swivels 16 and 17 at opposite ends thereof in any manner well known to the art.

Referring now to FIG. 2, which is a view of the forepiece swivel 17 of rifle 10 with sling 19 removed, forepiece swivel 17 will be described. It will be understood that swivel 16 is similar in construction to forepiece swivel 17 and thus that the description of the latter will suffice as a description of the former. Detachable swivels 16 and 17 are of a type well known in the art, but for purposes of clearly describing the present invention, will be briefly described herein. Forepiece swivel 17 is attached to a post 20 that extends outwardly from forepiece 14. Post 20 has a through aperture 21 that receives a pin 22 extending between a pair of spaced apart arms 23 that extend outwardly from a swivel body 24. Swivel 17 further includes a set screw 25 used to rigidly attach the swivel 17 to the forepiece 14. Swivel 17 is thus is rotatably attached to forepiece 14 about pin 22. Swivel 17 also includes a link 26 that is rotatably attached to swivel body 24 and to which sling 19 is attached. Link 26 is free to rotate about its attachment to swivel body 24.

Sling 19 is attached to the swivels 16 and 17 by threading an end 27 thereof through link 26 of swivel 16, slide buckle 28, which is attached to the other end 29 of sling 19, and then through link 26 of swivel 17, after which it is looped around link 26 of swivel 17 for attachment to sling 19. Sling end 27 is attached to the sling 19 by means of a well known fastener combination 30. It will be understood that the foregoing description of swivels 16 and 17 and sling 19 are descriptions of a well known type of swivel sling combination and that the present invention can find use with other known forms of swivels and slings.

Because of the rotatability of swivel 17 about its attachment to post 20 and link 26 about its attachment to swivel body 24, both set screw 25 and link 26 of forepiece swivel 17 will often create a scratch or gouge marks 31 in forepiece 14, thereby damaging the gun 10 and destroying its aesthetic as well as resale value. In addition, fastener combination 30 can also cause considerable damage of the weapon's finish as sling 19 moves relative to its attachments to swivels 16 and 17. The damage most usually occurs inwardly from the swivels towards the center of the weapon.

Also shown in FIG. 2 is a forepiece pad 32. Pad 32 is shown in its attached position in phantom outline as indicated by reference numeral 33. As shown, pad 32 comprises an outer layer 34 having an outer surface 36 having an aesthetically pleasing appearance, here that of a wood grain to match the wood of the stock. In addition, pad 32 may include other designs, for example, game animals such as deer, may also be shown on outer surface 36 as illustrated in FIG. 3. Outer layer 34 also has an inner surface 38 to which an inner layer 40 is attached. Inner layer 40 also has inner and outer surfaces 42 and 44, respectively. Inner layer 40 may comprise a two-sided adhesive tape such that outer surface 44 thereof will adhere to inner surface 38 of outer layer 34, and inner surface 42 of inner layer 40 can be adhered to the forepiece 14 using well known adhesives. Preferably, the adhesive used to attach pad 32 to weapon 10 will be a non-drying type so that the pad 32 can be removed from the rifle 10 without damaging the finish. As shown, pad 32 further includes an aperture 46 to receive swivel post 20. If desired, outer layer 34 may comprise a fine leather or vinyl type of material.

Referring now to FIG. 4, a stock pad 50 is shown in place on stock 12. Stock swivel 16 will, like forepiece swivel 17, cause scratching and gouging damage to stock 12. Thus, placement of a forepiece pad 50 over stock 12 where such damage would occur will prevent stock swivel 16 from damaging gun 10. Stock pad 50 is similar in construction in all respects to forepiece pad 32 except that as shown, it does not include an aperture such as aperture 46 to receive post 20 for stock swivel 16. Such an aperture may be provided if desired.

FIG. 3 represents an alternative embodiment of the present invention wherein a forepiece pad 60 is illustrated. Pad 60 comprises a single layer 62 having an aesthetically pleasing outer surface 64 and an inner surface 66 to which an adhesive material 68 is applied. A non-adhering backing strip 70 is attached to pad 60 during manufacture of pad 60 and is easily peeled away from pad 60 to expose the adhesive material 68 for application of the pad 60 to a firearm.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

What is claimed is:

1. Protective apparatus for preventing damage to a weapon, wherein said weapon includes a pair of swivels, a forepiece, and a stock, each of said swivels including a link, a first swivel being attached to the forepiece of the weapon and a second swivel being attached to the stock of the weapon, said swivels being provided for attaching a sling to said links, said damage being caused by said swivels engaging the forepiece and stock, wherein said apparatus comprises:

at least a first protective pad, said pad being attached to said weapon at a first location closely adjacent to said first swivel where damage from said link of said first swivel can be expected to occur, said first pad including an adhesive inner surface, said inner adhesive surface being provided for attachment of said pad to the weapon, wherein said inner adhesive surface comprises a first side of a two-sided adhesive strip, the second adhesive side of said strip being attached to said first pad.

2. Protective apparatus for preventing damage to a weapon, wherein said weapon includes a pair of swivels, a forepiece, and a stock, each of said swivels including a link, a first swivel being attached to the forepiece of the weapon and a second swivel being attached to the stock of the weapon, said swivels being provided for attaching a sling to said links, said damage being caused by said swivels engaging the forepiece and stock, wherein said apparatus comprises:

a first protective pad, said pad being attached to said weapon at a first location closely adjacent to said first swivel where damage from said link of said first swivel can be expected to occur; and a second protective pad, said second protective pad being attached to said weapon at a second location closely adjacent to said second swivel where damage from said link of said second swivel can be expected to occur.

3. The apparatus of claim 2 wherein said apparatus further comprises said first pad including an adhesive inner surface, said inner adhesive surface being provided for attachment of said pad to the weapon.

4. The apparatus of claim 3, wherein said inner adhesive surface comprises a first side of a two-sided adhesive strip, the second adhesive side of said strip being attached to said first pad.

5. Protective apparatus for preventing damage to a weapon, wherein said weapon includes a pair of swivels, a forepiece, and a stock, each of said swivels including a link, a first swivel being attached to the forepiece of the weapon and a second swivel being attached to the stock of the weapon, said swivels being provided for attaching a sling to said links, said damage being caused by said swivels engaging the forepiece and stock, wherein said apparatus comprises:

at least one protective pad, said pad being attached to said weapon at a location closely adjacent to said second swivel where damage from said link of said second swivel can be expected to occur, said at least one pad including an adhesive inner surface, said inner adhesive surface being provided for attachment of said pad to the weapon wherein said inner adhesive surface comprises a first side of a two-sided adhesive strip, the second adhesive side of said strip being attached to said first pad.

6. A weapon including:

a forepiece;

a stock;

first and second swivels, said first swivel being attached to said forepiece of said weapon and said second swivel being attached to said stock of said weapon, said first and second swivels each including a link, said swivels being provided for attaching a sling to said links; and protective apparatus for preventing damage to said weapon, said damage being caused by at least one of said swivels engaging said weapon so as to scratch the surface of said weapon closely adjacent to said at least one said swivel, wherein said protective apparatus comprises:

a protective pad, said pad being attached to said weapon closely adjacent to said at least one said swivel at a location where damage to said surface of said weapon can be expected to occur, said pad preventing said at least one swivel from engaging said surface of said weapon and preventing said at least one swivel from scratching said surface, wherein said apparatus further comprises said pad including an adhesive inner surface, said inner adhesive surface being provided for attachment of said pad to the weapon, wherein said inner adhesive surface comprises a first side of a two-sided adhesive strip, the second adhesive side of said strip being attached to said pad.

* * * * *